US009238544B2

(12) United States Patent
Schulz et al.

(10) Patent No.: US 9,238,544 B2
(45) Date of Patent: Jan. 19, 2016

(54) ARTICLE AND METHOD FOR SEALING A COLLAPSIBLE CONTAINER

(71) Applicant: 3M INNOVATIVE PROPERTIES COMPANY, St. Paul, MN (US)

(72) Inventors: Mark F. Schulz, Lake Elmo, MN (US); Scott D. Gullicks, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/342,557

(22) PCT Filed: Nov. 14, 2012

(86) PCT No.: PCT/US2012/064902

§ 371 (c)(1),
(2) Date: Mar. 4, 2014

(87) PCT Pub. No.: WO2013/078036

PCT Pub. Date: May 30, 2013

(65) Prior Publication Data

US 2014/0246454 A1 Sep. 4, 2014

Related U.S. Application Data

(60) Provisional application No. 61/562,567, filed on Nov. 22, 2011.

(51) Int. Cl.

| | |
|---|---|
| ***B67D 1/00*** | (2006.01) |
| ***B65D 83/00*** | (2006.01) |
| ***B65D 81/32*** | (2006.01) |

(52) U.S. Cl.

CPC ..... *B65D 83/0033* (2013.01); *B65D 81/325* (2013.01); *B65D 83/0072* (2013.01)

(58) Field of Classification Search

CPC ..... B65D 83/0033; B65D 81/325; B65D 83/0072; B05C 17/00553; B05C 17/00583; A61C 5/064

USPC ..... 222/82

See application file for complete search history.

(56) References Cited

U.S. PATENT DOCUMENTS

| | | | |
|---|---|---|---|
| 4,691,834 | A | 9/1987 | Bullock, III |
| 5,501,368 | A | 3/1996 | Brandhorst |

(Continued)

FOREIGN PATENT DOCUMENTS

| | | |
|---|---|---|
| CA | 1075647 | 4/1980 |
| DE | 10021769 | 12/2001 |

(Continued)

OTHER PUBLICATIONS

International Search Report for PCT International Application No. PCT/US2012/064902 Mailed on Feb. 28, 2013, 4 pages.

*Primary Examiner* — Patrick M Buechner
*Assistant Examiner* — Jeremy W Carroll
(74) *Attorney, Agent, or Firm* — Philip P. Soo

(57) ABSTRACT

Articles and related methods are provided, the articles including a collapsible container having a flexible wall and enclosing material to be dispensed, a cap secured to one end of the container, the cap including an outlet, an inner collar at least partially surrounding the end of the container, and an outer collar at least partially surrounding the inner collar, and a gap provided between the inner collar and the outer collar, the gap having a size sufficient to receive a folded section of the flexible wall as the container collapses and the material is dispensed through the outlet.

20 Claims, 8 Drawing Sheets

(56) References Cited

U.S. PATENT DOCUMENTS

| | | | | |
|---|---|---|---|---|
| 6,273,307 | B1 | 8/2001 | Gross | |
| 6,375,022 | B1 | 4/2002 | Zurcher | |
| 6,634,524 | B1 * | 10/2003 | Helmenstein | 222/94 |
| D603,668 | S | 11/2009 | Gullicks | |
| D636,500 | S | 4/2011 | Gullicks | |
| 8,544,686 | B2 * | 10/2013 | Williams | 222/95 |
| 2003/0085228 | A1 | 5/2003 | Oakes | |
| 2004/0035817 | A1 | 2/2004 | Lagler | |
| 2008/0144426 | A1 * | 6/2008 | Janssen et al. | 366/130 |
| 2009/0065527 | A1 * | 3/2009 | Buck | 222/95 |
| 2010/0133273 | A1 | 6/2010 | Thurman | |

FOREIGN PATENT DOCUMENTS

| | | |
|---|---|---|
| WO | 2007/095768 | 8/2007 |
| WO | 2008/076941 | 6/2008 |
| WO | 2009/117771 | 10/2009 |

* cited by examiner

ARTICLE AND METHOD FOR SEALING A COLLAPSIBLE CONTAINER

CROSS REFERENCE TO RELATED APPLICATIONS

This is a national stage filing under 35 U.S.C. 371 of PCT/US2012/064902, filed Nov. 14, 2012, which claims priority to U.S. Provisional Application No. 61/562567, filed Nov. 22, 2011, the disclosure of which is incorporated by reference in their entirety herein.

FIELD OF THE INVENTION

Provided are articles used in dispensers and methods associated thereof. More particularly, articles including collapsible containers and methods associated thereof are provided for dispensing flowable materials.

BACKGROUND

Flexible packaging can be an attractive option for the storage and dispensing of flowable materials, especially where the materials are to be isolated from the outside environment. Such materials can include, for example, curable or otherwise hardenable adhesives, coatings, sealants, and fillers used for vehicle body repair. One widely used type of flexible packaging is a collapsible container. Typically, this collapsible container is inserted into a reusable housing, and a cap with an outlet port is mounted to an opened end of the container for directing the materials toward an intended target. During use, external pressure is applied to the container, which collapses as its contents are dispensed through the outlet port. When depleted, the container can be simply disposed of, resulting in minimal cleanup.

It is generally desirable to form a seal between the opened end of the package and the cap to efficiently convey the materials through the outlet port and prevent leakage. This can be technically challenging, since the cap and housing are often rigid while the walls of the collapsible container are comparatively soft and pliable. Different approaches have been implemented. In one approach, a small amount of a glue or other hardenable composition is applied between the inner perimeter of the cap and the collapsible container. This glue often serves not only a structural purpose in connecting the package to the cap but also a barrier purpose in preventing the materials from seeping through the seam between these two components. Another approach is to configure the interior geometry of the cap such that a hermetic seal is formed between the cap and collapsible container when positive pressure is applied between the package and the cap.

SUMMARY

It was discovered that the conventional approaches described above have notable drawbacks or limitations. First, glues and other structural adhesives connecting the cap to the package can be prone to cohesive or adhesive failure, causing leakage of the package and cap assembly. These materials may also degrade over time or react adversely to the materials in the package, thus accelerating their failure as sealing elements. The dispensing of monomers and other chemically reactive components can be especially problematic. Second, use of a hermetic seal under pressure can impose engineering and manufacturing constraints on the allowable geometries of the cap. For example, these geometries may not be injection moldable. Moreover, these sealing mechanisms generally position the outlet port of the cap approximately in line with the longitudinal axis of the collapsible container to form an adequate seal. Unfortunately, this can constrain the types of dispensing configurations that may be used with the collapsible container.

In one aspect, a cartridge for a dispenser is provided. The cartridge comprises: a collapsible container having a flexible wall and enclosing material to be dispensed; a cap secured to one end of the container, the cap comprising: an outlet, an inner collar at least partially surrounding the end of the container, and an outer collar at least partially surrounding the inner collar; and a gap provided between the inner collar and the outer collar, the gap having a size sufficient to receive a folded section of the flexible wall as the container collapses and the material is dispensed through the outlet.

In another aspect, a cartridge for a dispenser is provided, the cartridge comprising: a collapsible container having a flexible wall and enclosing material to be dispensed; and a housing at least partially surrounding the container, the housing further comprising: a cap having an outlet and a collar contacting the flexible wall of the container along an engagement surface; and a shell at least partially surrounding the cap, wherein the cap and shell collectively provide a gap extending along the perimeter of the collar adjacent the engagement surface, the gap having a transverse dimension sufficient to receive a folded section of the flexible wall as the container collapses and the material is dispensed through the outlet.

In still another aspect, a mobile mixing dispenser is provided, comprising: a frame comprising a barrel having a front and rear end and a handle projecting from the barrel; a chamber located proximate the front end of the barrel; a cartridge located in the chamber, the cartridge comprising: a collapsible container having a flexible wall and enclosing materials to be dispensed; a cap having an outlet and a collar contacting the flexible wall of the container along an engagement surface; and a shell at least partially surrounding the cap, wherein the cap and shell collectively provide a gap extending along the perimeter of the collar adjacent the engagement surface, the gap having a transverse dimension sufficient to receive a folded section of the flexible wall as the container collapses and the materials are dispensed through the outlet.

In yet another aspect, a method of sealing a collapsible container comprising: providing a housing comprising a cap and a shell, the cap having an outlet and an inner collar and the shell at least partially received in the inner collar and radially displaced from the cap, whereby an outward-facing surface of the inner collar and an inward-facing surface of the shell are separated by a gap; placing the collapsible container in the housing to provide a seal between an inward-facing surface of the inner collar and a flexible wall of the collapsible container; and collapsing at least a portion of the container whereby the flexible wall folds upon itself and progressively extends into the gap while conforming to the outward-facing surface of the collar to improve the seal as the materials are dispensed.

DETAILED DESCRIPTION

Described in further detail below, by way of illustration and example, are devices and methods directed to exemplary embodiments of the invention. Some of these embodiments are useful, for example, in the storage and dispensing of hardenable multi-component materials. However, the invention is not limited to these applications. The components dispensed need not be hardenable. The provided assemblies and methods may be used for any number of purposes that include the storage and dispensing of flowable materials generally, which could include both liquids and solids (e.g. particulate) and may implicate only one component or upwards of three or more components. Particular aspects of these devices and methods are described herein with respect to the accompanying illustrations; however, additional options and advantages may be found in U.S. Patent Publication No. 2008/0144426 (Janssen, et al.). Materials that can be dispensed include liquids, pastes, gels, and flowable solids such as flowable particulate streams.

The assemblies and methods described herein provide an alternative dispensing solution that obviates many of the shortcomings mentioned above. The provided assemblies use a cap with an inner collar with an inner and outer surface, and a shell that at least partially surrounds the inner collar. The cap and the shell at least partially encapsulate the collapsible container, engaging with each other to provide a gap between the outer surface of the inner collar and the inner surface of the shell. Prior to dispensing, the inner surface of the inner collar contacts the collapsible container to form an initial seal. However, as the materials are dispensed from the package, the package collapses, inducing the wall of the collapsible container to fold upon itself and progressively extend into the gap between the collar and the shell. As the package is further compressed, the collapsible container forms a seal along both the inner and outer surfaces of the collar.

By virtue of the gap adjacent the collar, the configuration is "self-sealing"; that is, the greater the pressure applied by the collapsible container against the cap, the better the seal formed between the collapsible container and the collar. The effectiveness of the seal can be attributed, in part, by the dual-engagement surfaces between the collapsible container and the collar, provided on both the inward-facing and outward-facing surfaces of the collar. During a dispensing operation, the rim of the collar also provides a self-wiping mechanism whereby the contents of the collapsible container are substantially pressed out of the folded-over wall of the package as it progressively descends into the gap. This, in turn, provides for a more efficient dispensing operation and also results in a compact and convenient configuration for disposal once the contents of the collapsible container have been dispensed.

Figure 1:
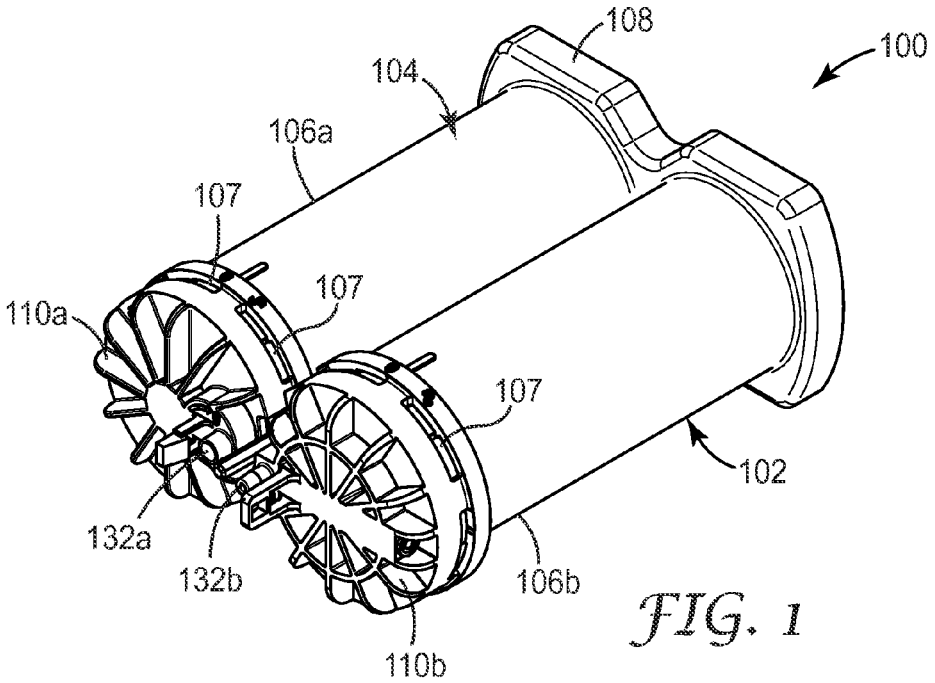
FIG. 1 is a perspective view showing the top and front sides of a cartridge assembly according to one exemplary embodiment.

A cartridge assembly according to one embodiment is illustrated in FIG. 1 and designated by the numeral 100. The assembly 100 includes an external housing 102 having a configuration that allows for simultaneously dispensing two discrete components. The housing 102, in turn, includes a shell 104 and a pair of caps 110*a*, 110*b* individually and releasably coupled to the shell 104. The caps 110*a*, 110*b* and shell 104 can be made from any of a number of polymeric materials, including polyethylene, polypropylene, nylon, polycarbonates, polyamides, polyphenylene oxide, polystyrene, polyurethane, polymethacrylates, polyesters, copolymers thereof, and other thermoplastic and thermoset materials. The polymeric material may also be filled with glass or other inorganic filler. Any of the caps 110*a*, 110*b* or shell 104 could also be constructed from non-polymeric materials, including metals such as aluminum, steel, and the like. These components could be manufactured by injection molding, die-casting, machining, stamping, thermoforming, or any other processing method known to one skilled in the art.

The shell 104 is hollow and has a bifurcated shape generally defined by a first tube 106*a* and a second tube 106*b* commonly joined to a back plate 108, as shown. While tubes 106*a*, 106*b* are cylindrical in this exemplary embodiment, other cross-sectional shapes are also possible. The tubes 106*a*, 106*b* are arranged alongside each other in a generally parallel configuration and may or may not be coupled directly to each other. Having separate tubes 106*a*, 106*b*, as shown here, can allow two-part materials to be dispensed simultaneously but kept separate from each other before being dispensed. Optionally and as shown, the tubes 106*a*, 106*b* and the back plate 108 can be manufactured as a unitary component. As shown in FIG. 1, the caps 106*a*, 106*b* are secured to a plurality of nubs 107 on the respective tubes 106*a*, 106*b* using a locking, bayonet-type mechanism. Alternatively, a screw-type connection using threads located on the tubes 106*a*, 106*b*, or any other mechanism, could also be used.

Figure 2:
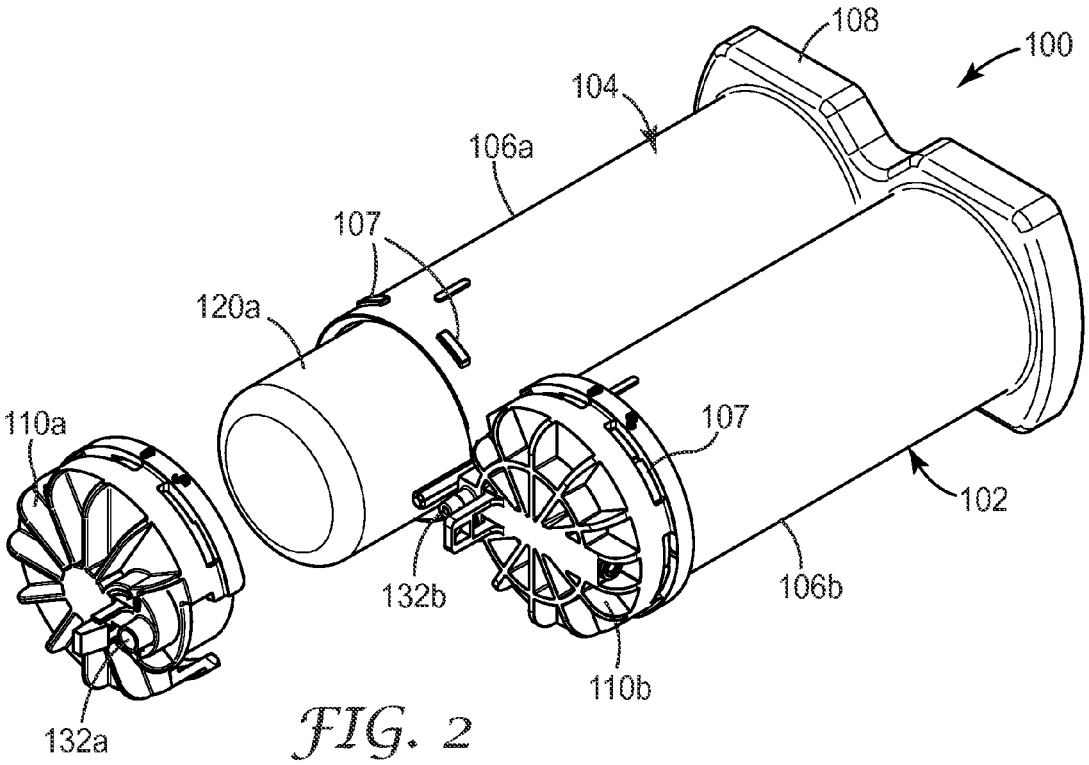
FIG. 2 is a similar view of the assembly in FIG. 1 except partially disassembled to reveal an interior component.

FIG. 2 shows the assembly 100 with the cap 110*a* removed from the shell 104, revealing an elongated collapsible container 120*a* received in the tube 106*a* and partially withdrawn from the shell 104 for illustration purposes. As shown, the container 120*a* is generally cylindrical with a shape substantially conforming to the surrounding tube 106*a*. The housing 102, shown here, fully encapsulates the container 120*a*, although embodiments are contemplated where the housing 102 only partially surrounds the container 120*a*. The container 120*a* encloses a first component to be dispensed from the assembly 100 during a dispensing operation. In a preferred embodiment, the tube 106*b* receives a second container containing a second component. When dispensing from the assembly 100, the first and second components can be simultaneously dispensed through respective outlets 132*a*, 132*b* located on the caps 110*a*, 110*b* and mixed in a downstream operation to provide a multi-component material. Optionally, the first and second components are reactive components that are hardenable upon mixing with each other.

Figure 3A:
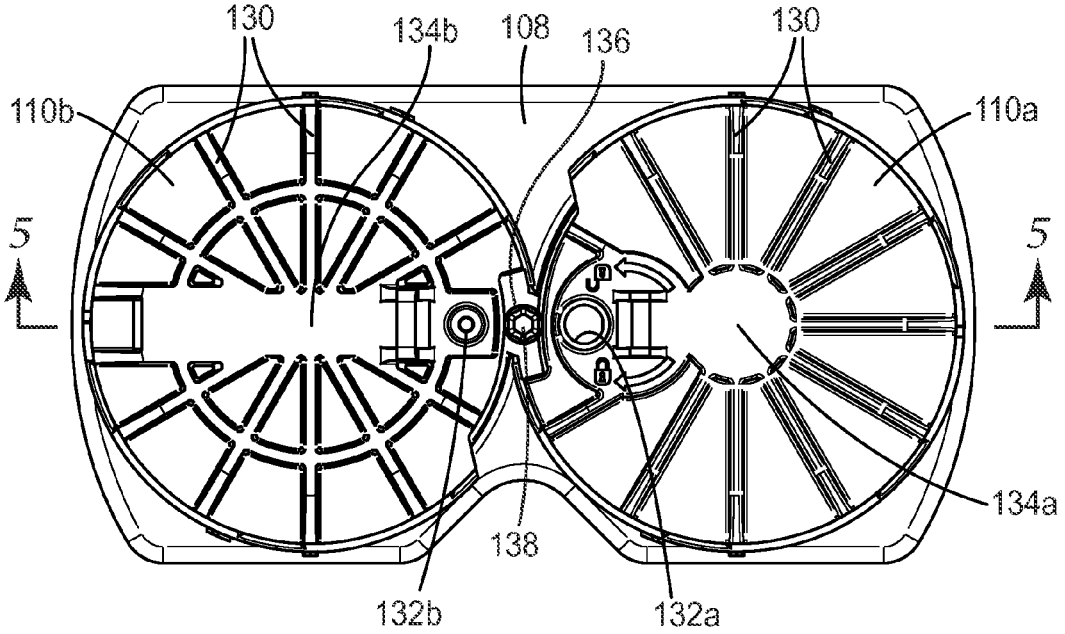
FIG. 3*a* is a front view of the assembly of FIGS. 1-2, showing the front side.
Figure 3B:
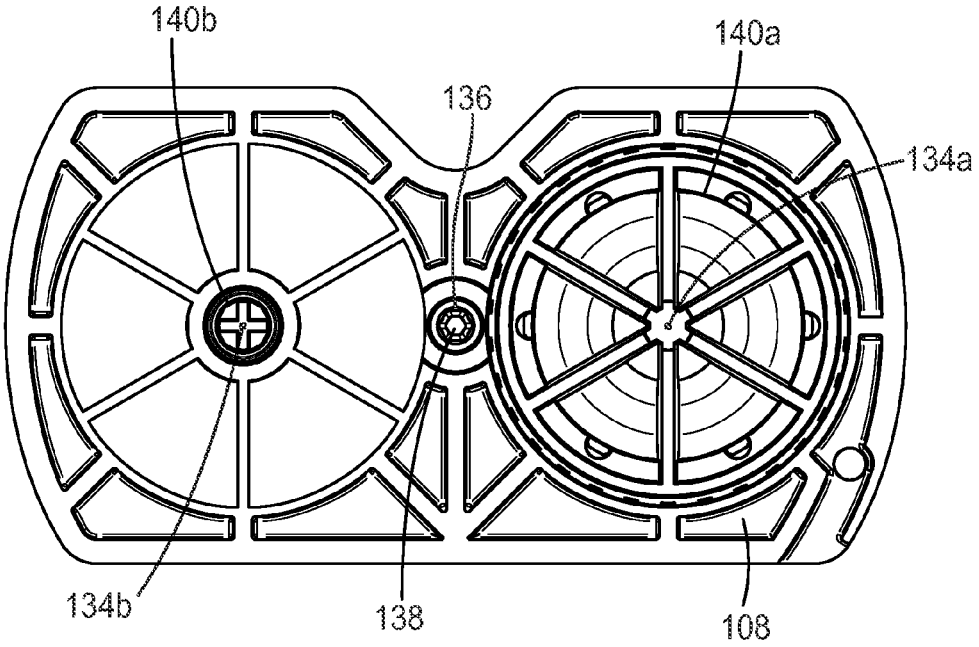
FIG. 3*b* is a back view of the assembly of FIGS. 1-3*a*, showing the back side.

FIGS. 3*a* and 3*b* show the front and back sides (i.e. the dispensing end and its opposite end) of the assembly 100, respectively. Although obscured in these figures, the tubes 106*a*, 106*b* are generally cylindrical and symmetric about respective reference axes 134*a*, 134*b*. In this embodiment, the references axes 134*a*, 134*b* are parallel with each other. However, alternative embodiments are also contemplated that include, for example, tubes that have non-circular cross-sectional shapes (e.g. oval, elliptical, semi-circular, rectangular, triangular, etc.) and may extend along respective axes that are not generally parallel with each other.

As further shown in FIG. 3*a*, a series of ribs 130 extend radially along the exposed side of each cap 110*a*, 110*b*. The ribs 130 provide additional structural integrity to the caps 110*a*, 110*b* and allow the caps 110*a*, 110*b* to be easily rotated for engagement and disengagement from the shell 104. Optionally and as shown, the outlets 132*a*, 132*b* are offset from the geometric centers of their respective caps 110*a*, 110*b* (as viewed along their respective reference axes 134*a*, 134*b*). As will be described later, this configuration can be advantageous, for example, when guiding the flow of the first and second components into a dispensing nozzle.

Referring again to FIGS. 3*a* and 3*b*, a mixer drive passageway 136 extends through the housing 102 between the tubes 106*a*, 106*b* in a direction parallel to the reference axes 134*a* and 134*b*. Received in the mixer drive passageway 136 is an elongated drive shaft 138. The drive shaft 138 passes through the assembly 100, and can be used to couple a dynamic mixer on one end to a drive mechanism on the opposite end. Optionally and as shown here, the shaft 138 has a polygonal cross-section (here hexagonal) to allow mating engagement with one or both of the mixer and drive mechanism. In an alternative embodiment, the passageway 136 is kept open, allowing a suitable drive shaft to be threaded through the passageway 136 when the assembly 100 is installed in a dispenser.

Figure 4:
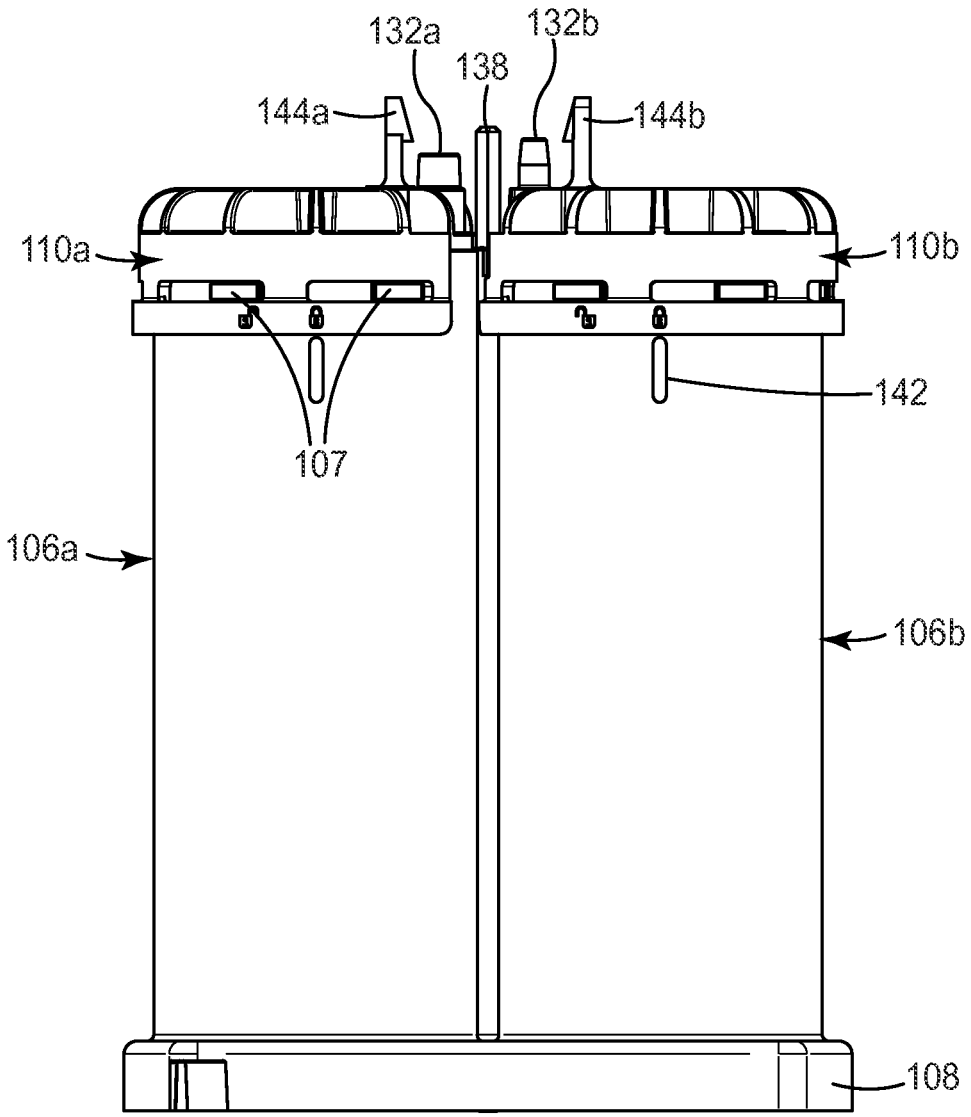
FIG. 4 is a top view of the assembly of FIGS. 1-3*b* showing the top side.

FIG. 4 reveals some additional optional features on the top side of the assembly 100 in greater detail. For example, alignment indicia 142 are present on the outer surface of the tubes 106*a*, 106*b* and assist the user in engaging and disengaging the caps 110*a*, 110*b* from the shell 104. Additionally, a pair of prongs 144*a*, 144*b* are located on the front sides of the caps 110*a*, 110*b*. These prongs 144*a*, 144*b* have undercuts that facilitate the coupling of a dispensing nozzle (not shown) to the outlets 132*a*, 132*b* of the caps 110*a*, 110*b*.

Figure 5:
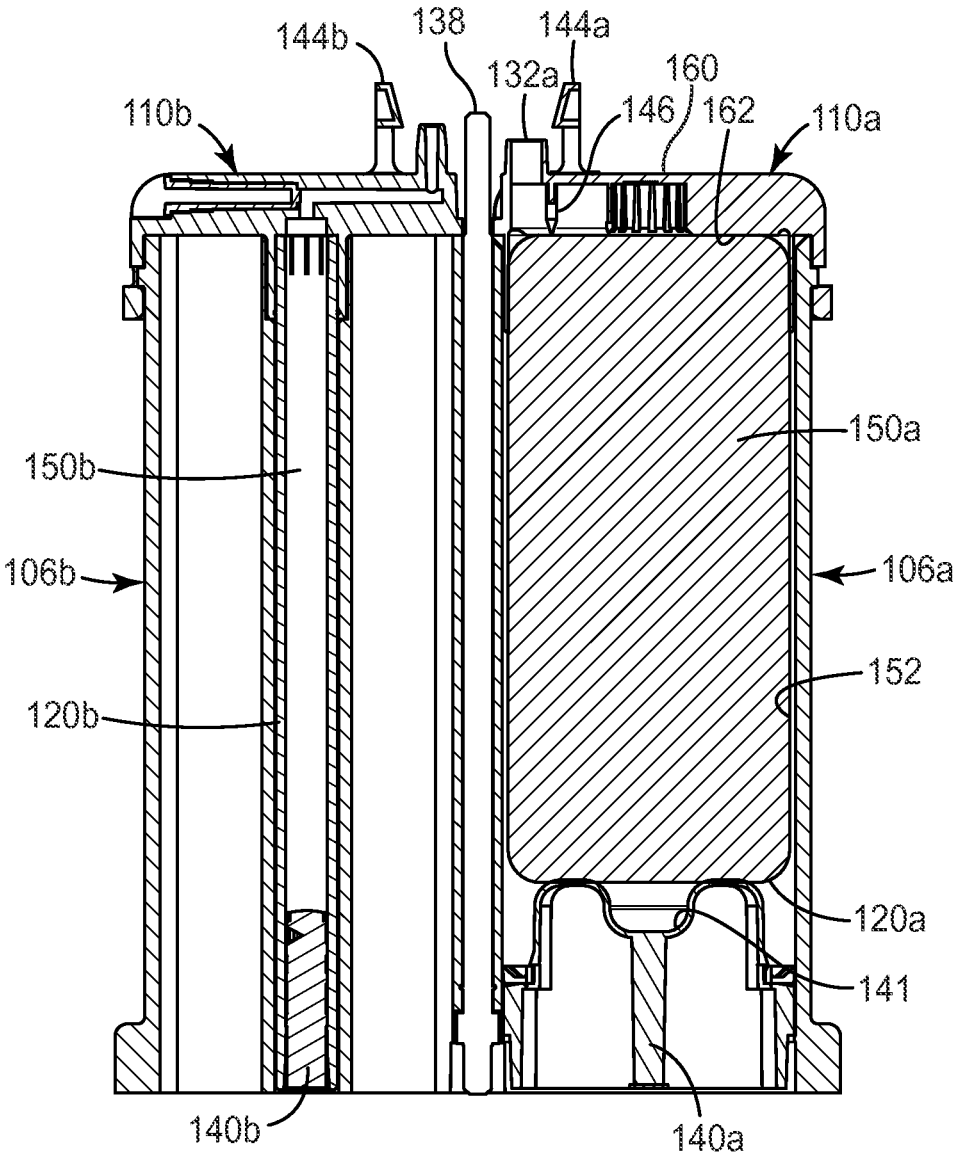
FIG. 5 is a cross-sectional view of the assembly of FIGS. 1-4 taken along section 5-5 as denoted in FIG. 3*a*.

FIG. 5 presents a cross-section of the assembly 100 along the line 5-5 shown in FIG. 3*a*, showing its configuration of internal components. As previously indicated, the container 120*a* is collapsible by virtue of having a relatively thin, flexible wall 152. Examples of particularly suitable materials for the flexible wall 152 include film/foil laminates, such as those used in connection with packaging of dental impression/restorative materials in pouches for mixing and dispensing. Other potentially suitable materials include metal foils such as aluminum foil, and polymeric liners such as liners of polyethylene, polypropylene, polyesters, and nylon. In exemplary embodiments, the container 120*a* has a length-to-diameter ratio (i.e. aspect ratio) of at least 2:1. As used here, "diameter" refers to the largest transverse dimension of an object, which may or may not have a circular cross-section.

The flexible wall 152 preferably has a thickness that is sufficiently high to maintain structural integrity of the container 120*a* but also sufficiently thin to easily collapse as its contents are dispensed. In some embodiments, the thickness is at least 0.025 millimeters, at least 0.040 millimeters, at least 0.050 millimeters, or at least 0.1 millimeters. In some embodiments, the flexible wall 152 has a thickness of up to 0.5 millimeters, up to 0.20 millimeters, or up to 0.15 millimeters.

The container 120*a* contains a first component 150*a* and is surrounded collectively by the cap 110*a*, tube 106*a*, and piston 140*a*. As shown, the cap 110*a* has a front side 160 and a back side 162. The container 120*a* need not be fully enclosed, although in practice this may be preferred to avoid bursting when the container 120*a* is compressed during a dispensing operation. A second container 120*b*, which contains a second component 150*b*, is secured to the cap 110*b* and is received in the adjacent tube 106*b*. In this example, the container 120*b* has a substantially smaller bore, and is not collapsible. As FIG. 5 shows, the container 120*b* occupies a substantially smaller volume, with a 50:1 volumetric ratio between the components 150*a*, 150*b*. Depending on the application, however, other volumetric ratios, such as 10:1, 5:1, 2:1, and the like, may also be used.

Each component 150*a*, 150*b* of the two-component system can be stored in its respective container 120*a*, 120*b* until a suitable time at which it is then dispensed and mixed. In some embodiments, the mixing ratio is pre-determined by the manufacturer of the assembly 100, in which the volumetric ratio between the two sides enables the two components to be mixed in the desired amounts. The ratios enumerated above are common ones, but others are also possible. Any of these configurations could advantageously employ a pair of collapsible containers to obtain the benefits described therein.

In one embodiment, the components 150*a*, 150*b* are dispensed by urging one or both pistons 140*a*, 140*b* into the tubes 106*a*, 106*b* from the back side of the assembly 100 (opposite the caps 110*a*, 110*b*). The compressive action of the piston 140*a* against the container 120*a* causes the flexible wall 152 to advance forward against a spike 146 located on an opposing surface of the cap 110*a*. The spike 146 pierces the flexible wall 152 thereby creating an opening in the container 120*a* adjacent the outlet 132*a*. As further compression is applied, the first component 150*a* is forced out of the assembly 100 through the outlet 132*a* (now in fluid communication with the collapsing container 120*a*). During this process, the flexible wall 152 buckles and collapses upon itself as the first component 150*a* is dispensed and the volume of the container 120*a* decreases.

Particular features of the piston 140*a* can facilitate operation of the assembly 100. For example, the shape of the piston 140*a* can be advantageously provided with a pocket 141 to accommodate for a "pigtail" (not shown) where the end of the container 120*a* is secured using, for example, a metal clip. The piston 140*a* can also have a shape that helps expel all of the first component 150*a* from the assembly 100 by nesting inside the cap 110*a*. Additionally the piston 140*a* could be provided with a wiper that is specifically designed to promote collapsing of the container 120*a* without pinching of the flexible wall 152 between the piston 140*a* and the inward-facing wall of the shell 104.

Preferably, the pistons 140*a*, 140*b* are suitably sized to slide through the tubes 106*a*, 106*b*. In some embodiments, the pistons 140*a*, 140*b* are retained within the tubes 106*a*, 106*b* by a pair of movable plungers slidably coupled to the shell 104. The plungers, which can be controlled by a dispenser, engage the back sides of the pistons 140*a*, 140*b* and can be used to advance the pistons 140*a*, 140*b* through the tubes 106*a*, 106*b* to dispense materials from the containers 120*a*, 120*b*. In the embodiment shown here, the assembly 100 is provided without built-in plungers. To engage the pistons 140*a*, 140*b*, the plungers could be incorporated into a suitable dispenser, and inserted into the cavities of the tubes 106*a*, 106*b* upon loading the cartridge assembly 100 into the dispenser. Plungers, if provided, can be advanced manually by a user under hand force or advanced in a more controlled manner using an automated dispensing machine that can be pneumatically or electronically controlled if desired, for instance. Construction should be such that plungers are able to advance easily and smoothly without buckling or binding. In some embodiments, the pistons 140*a*, 140*b* can be built into the plungers instead of the assembly 100.

Figure 6:
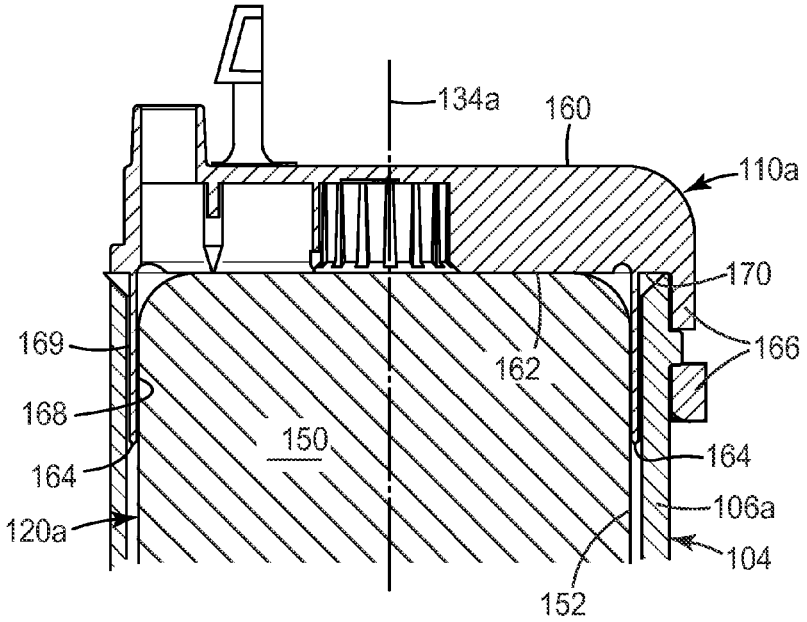
FIG. 6 is an enlarged fragmentary cross-sectional view showing a front portion of the assembly of FIGS. 1-5 prior to a dispensing operation.

FIG. 6 shows, in greater detail, the interface between the cap 110*a* and the shell 104 when assembled. Located on the back side 162 of the cap 110*a* is an annular inner collar 164 having a generally circular configuration that is complemental to the corresponding tube 106*a*. Like the cap 110*a* overall, the inner collar 164 is concentric about the reference axis 134*a* and extends uninterrupted along the periphery of the cap 110*a*. Although not shown here, the inner collar 164 may optionally contain one or more gaps along the perimeter of the cap 110*a* while still maintaining an adequate seal.

As shown, the collar 164 has a relatively thin wall, with approximately parallel inward-facing and outward-facing surfaces 168, 169. Preferably, the collar 164 has an axial dimension of at least 2 percent, at least 5 percent, at least 8 percent, at least 10 percent, at least 15 percent, at least 20 percent, at least 30 percent, at least 40 percent or at least 45 percent of the overall length of the container as measured along a direction parallel to the reference axis 134*a*. To enable the materials from the container 120*a* to be fully expelled, the collar 164 could have an axial dimension of up to 50 percent of the length of the collapsible container 120*a*. In some embodiments, collar 164 has an axial dimension that is at least about 0.3 centimeters, at least about 0.5 centimeters, at least about 0.75 centimeters, at least about 1.0 centimeters, at least about 1.25 centimeters, or at least about 1.5 centimeters, as measured along a direction parallel to the reference axis 134*a*.

Also located on the back side 162 of the cap 110*a* is an annular outer collar 166. The outer collar 166 partially surrounds the inner collar 164 and is also generally symmetric about the reference axis 134*a*. Unlike the inner collar 164, however, the outer collar 166 has a discontinuity along a portion of the perimeter of the cap 110*a*, presenting a generally "C"-shaped cross-section as shown in FIG. 2. Located between the inner and outer collars 164, 166 is an annular recess 170. As further shown in FIG. 6, the tube 106*a* of the shell 104 is received in the annular recess 170 and interlocks with the outer collar 166 in encircling relation. Optionally and as shown, the front rim of the shell is slightly beveled to facilitate insertion into the annular recess 170.

As further shown in FIG. 6, the cap 110*a* is secured to one end of the container 120*a*. In this particular embodiment, the flexible wall 152 of the container 120*a* extends along the inward-facing surface 168 of the inner collar 164. The inward-facing surface 168 contacts the flexible wall 152 of the container 120*a* along an annular engagement surface. This engagement surface, which represents the contact interface between the inner collar 164 and the container 120*a*, extends continuously along the circumference of the container 120*a* to form an initial seal. To avoid wrinkling the flexible wall 152 along the circumference of the container 120*a*, it is preferred that the inward-facing surface 168 has a contour that closely conforms to that of the flexible wall 152 along the engagement surface. If desired, the overall diameter of the container 120*a* could be sized slightly larger than the inner diameter of the inner collar 164 to provide a press fit configuration.

Figure 7A:
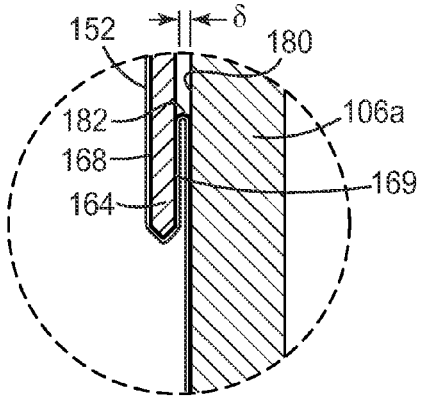
FIG. 7A is an inset showing, in more detail, a portion of the cross-sectional view in FIG. 7.
Figure 7:
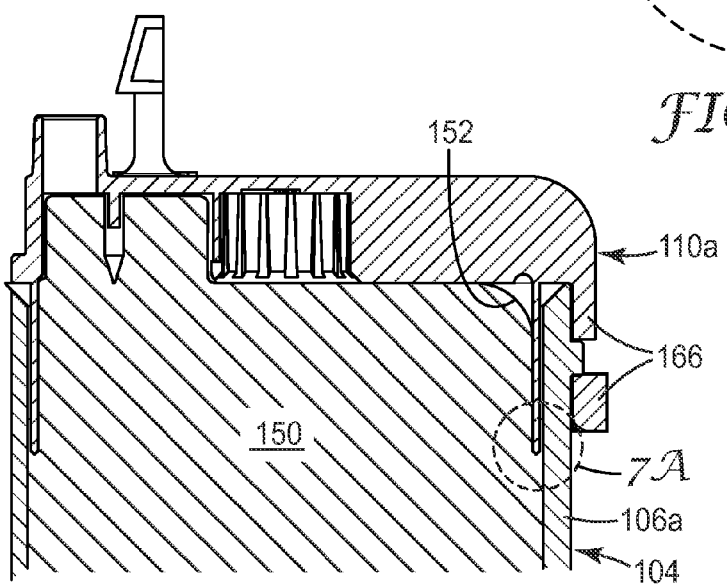
FIG. 7 is a similar cross-sectional view to that provided in FIG. 6 except showing the assembly during the course of a dispensing operation.

FIG. 7 and accompanying inset FIG. 7A show the behavior of the flexible wall 152 as the container 120*a* collapses during a dispensing operation. The manner in which this occurs is guided in part by additional structural features of the cap 110*a* and shell 104. When the tube 106*a* is fully seated in the annular recess 170, the cap 110*a* and the shell 104 collectively provide a gap 180 extending along the perimeter of the collar 164 adjacent the engagement surface. In this embodiment, the gap 180 is an annular gap having a transverse dimension (i.e. gap width 6, as shown in FIG. 7A) sufficient to receive a folded section 182 of the flexible wall 152 as the container 110*a* collapses and materials are dispensed through the outlet 132*a*. Preferably, the cap 110*a* and shell 104 are both sufficiently rigid and dimensioned that the gap 180 has a transverse dimension that is relatively constant along the perimeter of the inner collar 164 when the cap 110*a* and shell 104 are mutually engaged.

When sufficient compressive force is applied to the container 120*a* by the piston 140*a*, the hydrostatic pressure provided by the first component 150 urges the flexible wall 152 in outward directions. As a result, the container 120*a* fills, if possible, free space available between the container 120*a* and the surrounding housing 102. If the flexible wall 152 is sufficiently thin and pliable, it will spontaneously fold upon itself and progressively extend into the gap 180 as shown in FIG. 7A. Because the gap 180 is relatively narrow, the first component 150 is continually expelled from the folded section 182 as the fold propagates along the inward-facing surface 168 of the collar 164. Advantageously, this mechanism can continuously improve the seal by expanding the sealing interface as materials are dispensed from the container 120*a*. As a further benefit, the container 120*a* can conveniently collapse into a highly compact structure while minimizing waste.

Preferably, the gap 180 has a width that is large enough to initiate the orderly folding of the flexible wall 152 at the proper location shown in FIG. 7A but also small enough to prevent significant amounts of the first component 150 from being extruded into the gap 180. The optimal dimension may depend at least in part on what is being dispensed, such as, for example, the viscosity of the first component 150. In one exemplary embodiment, the collar 164 has sufficient flexibility allowing the collar 164 to flex in radial directions in response to pressure exerted by the flexible wall 152 of the container 120*a*. Under such conditions, the gap 180 could expand to accommodate the folded section 182 during a dispensing operation. The collar 164 could also exert compressive force on the folded section 182 along radial directions to further secure the seal between the cap 110*a* and the container 120*a* and prevent leakage.

As shown in FIG. 7A, the transverse dimension (δ) of the gap 180 is defined as the distance between the outward-facing surface 169 of the inner collar 164 and the opposing surface of the shell 104. It is also possible, however, that the gap 180 can be solely provided by the cap 110*a*. For example, although not shown here, the gap 180 could be defined by an outward-facing surface of a first inner collar and an inward-facing surface of a second inner collar, both of which are located on the cap 110*a*. In some embodiment, the transverse dimension is at least 1 time, at least 1.5 times, at least 2 times, at least 2.1 times, at least 2.2 times, at least 2.3 times, at least 2.4 times, or at least 2.5 times the thickness of the flexible wall 152. In some embodiments, the gap is up to 20 times, up to 10 times, up to 7 times, up to 5 times, up to 4 times, up to 3.5 times, or up to 3 times the thickness of the flexible wall 152.

A beneficial aspect of the configuration shown in FIG. 7A derives from the manner in which the flexible wall 152 adopts an acute bend (in this case, a 180 degree bend) along the rim of the collar 164 as it conforms to the inward-facing and outward-facing surfaces 168, 169 of the collar 164. Advantageously, the conformal engagement between the rim of the collar 164 and the flexible wall 152, along with the broad surface of engagement between the between the surfaces 168, 169 of the collar 164 and the folded section 182, in combination can provide a seal that effectively prevents leakage of the compenent 150*a* past the engagement surface without need for additional sealing materials such as a sealing glue. As a further advantage, the conformal engagement above allows the cap 110*a* to securely couple to the container 120*a* without need for an adhesive or mechanical connectors such as clips.

In the illustrated embodiment, the collar 164 has a blade-like, dual-tapered terminal edge which may be advantageous in initiating the formation of the folded section 182 at the entrance of the gap 180. However, this edge is preferably not unduly sharp or else the collar 164 could unintentionally puncture the container 120*a*.

Figure 8:
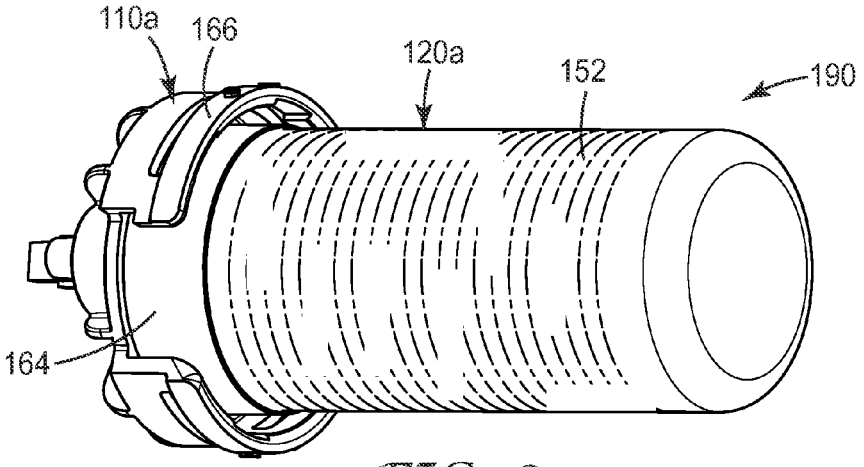
FIG. 8 is a perspective view showing the bottom and side of a sub-assembly in which certain external components are removed from the assembly of FIGS. 1-7.
Figure 9:
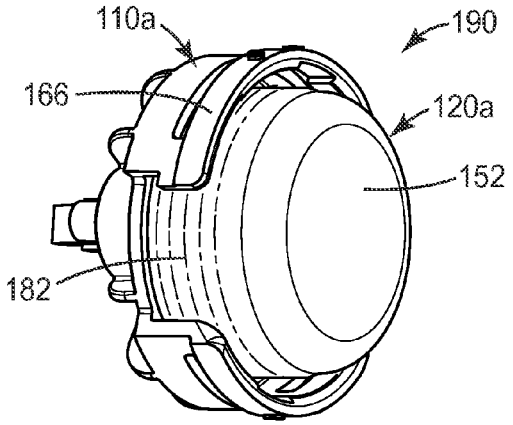
FIG. 9 is a perspective view again showing the sub-assembly of FIG. 8, except at the conclusion of a dispensing operation.

FIGS. 8 and 9 each show the cap 110*a* and container 120*a* (or cartridge sub-assembly 190) as it would appear at the beginning and end of a dispensing operation, respectively. As shown by these figures, the container 120*a* is collapses down to a fraction of its original size after its contents are fully dispensed. FIG. 9 shows how the flexible wall 152 folds in upon itself along the outward-facing surface 169 of the inner collar 164. As indicated in this figure, the inner collar 164 is completely hidden by the folded section 182 of the flexible wall 152. In some embodiments, the folded section 182 traverses the entire width of the inner collar 164, terminating at the base of the annular recess 170 between the inner and outer collars 164, 166. At the conclusion of a dispensing operation, the cap 110*a* and the container 120*a* can be removed from the dispenser together and disposed of in a compact, mess-free unit.

FIG. 8 also shows an intermediate step in an exemplary method of assembling the cap 110*a*, container 120*a*, and shell 104. In the configuration shown, the container 120*a* is first inserted into the inner collar 164 of the cap 110*a*. Once engaged, the container 120*a* and cap 110*a* can then be slidably received into the shell 104 shown in FIGS. 1 and 2. Alternatively, and in view of the fact that the tube 106*a* of the shell 104 is open on both ends (the front and back sides), the cap 110*a* can be initially secured to the shell 104 and then the container 120*a* inserted into the cap 110*a*/shell 104 assembly from the rear. The optional piston 140*a* can be received in the shell 104, either before or after the insertion of the container 120*a* in the shell 104, to complete the cartridge assembly 100. Furthermore, any of the procedures above could be implemented after the shell 104 has already been installed in a suitable dispenser.

In a preferred embodiment, the sub-assembly 190 comes pre-assembled by the manufacturer. Optionally, at least a portion of the flexible wall 152 and the container 120*a* are adhesively or mechanically joined together for the convenience of the user. As another option, the shell 104 can be incorporated into a suitable dispenser. Advantageously, the shell 104 does not come into contact with the materials in the containers 120*a*, 120*b* and can thus be conveniently reused, reducing waste. Accordingly, it can be advantageous for a manufacturer to provide the user the cap 110*a* and container 120*a* together as disposable cartridge. If even less waste is desired, the container 120*a* could be detached from the cap 110*a* for disposal (for example, upon reaching the configuration shown in FIG. 9) and the cap 110*a* cleaned and reused.

Figure 10:
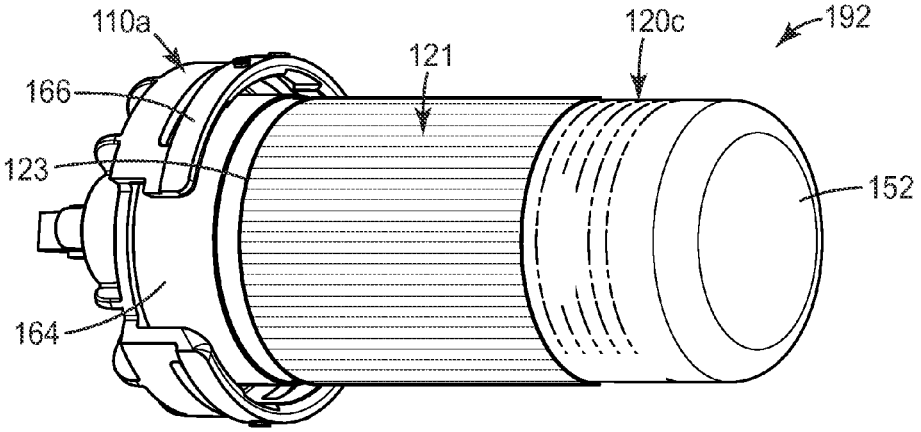
FIG. 10 is a perspective view showing the bottom and side of a sub-assembly similar to that of FIG. 8 but according to another embodiment.

FIG. 10 shows a cartridge sub-assembly 192 using a collapsible container 120*c* according to another embodiment. The container 120*c* uses a guide member 121 that directs and facilitates the folding of the flexible wall 152 as the container 120*c* collapses. The guide member 121 is preferably a thin layer of material adhered to the flexible wall 152 in encircling relation, and stiffens underlying portions of the flexible wall 152. As further shown in FIG. 10, the guide member 121 is positioned on the flexible wall 152 such that a terminal edge 123 of the guide member 121 is slightly spaced from the opposing edge of the inner collar 164. In this configuration, the guide member 121 can help direct entry of the flexible wall 152 into the gap 180 (not visible in FIG. 10). The guide member can also assist by concentrating stress to initiate a fold in the flexible wall 152 in a location adjacent the entrance of the gap 180. Optionally, the guide member 121 serves a secondary function as a label adhered to the outer surface of the container 120*c* for providing identification of the component 150*a* (hidden in FIG. 10), instructions for use, warnings, specifications, and so forth.

The distance from the top edge of the guide member 121 to the bottom edge of the inner collar 164 can be varied, bearing in mind that if the distance is too small (e.g. they are directly adjacent to each other) the guide member 121 may slip inside, instead of outside, the inner collar 164 and prevent the flexible wall 152 from properly folding into the gap 180. On the other hand, if the label is too far away, leading sections of the flexible wall 152 may crumple at the entrance of the gap 180, preventing the flexible wall 152 from forming a proper seal within the gap 180. A similar benefit could be realized by providing a flexible wall 152 that displays a sudden change in stiffness along desired locations. For example, the flexible wall 152 could have a first stiffness along areas adjacent the inner collar 164 and a second stiffness along areas extending beyond a terminal edge of the inner collar 164, the second stiffness being significantly greater than the first stiffness.

Figure 11:
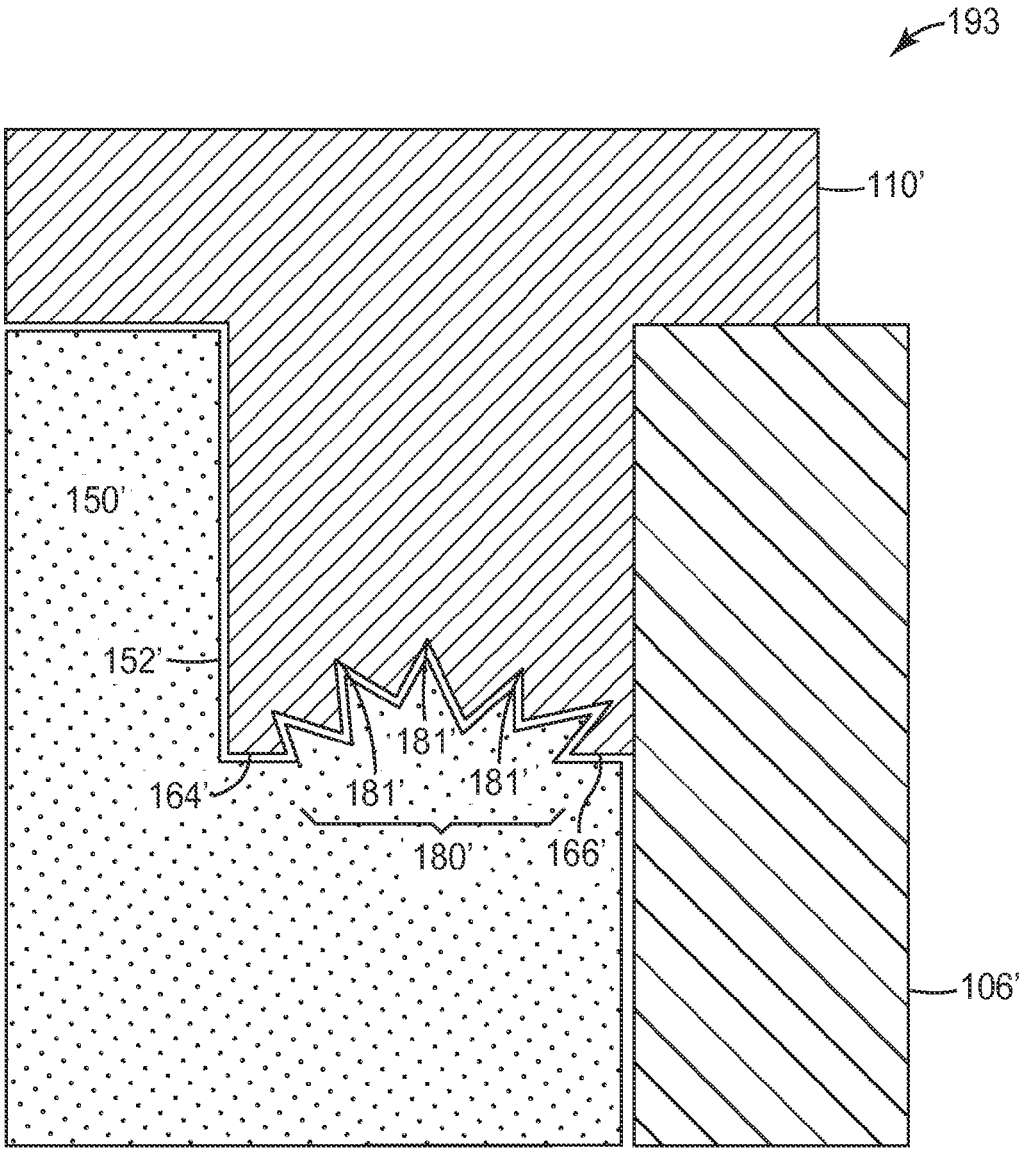
FIG. 11 is an enlarged, fragmentary cross-sectional view showing a sub-assembly according to still another embodiment.

FIG. 11 shows a cross-section of a sub-assembly 193 with a somewhat different sealing configuration. Like sub-assemblies 190, 192, the sub-assembly 193 includes a cap 110' with inner and outer collars 164', 166' and a shell 106'. Both the inner collar 164' and an outer collar 166', however, are located on the inside of the shell 106'. Located between the inner and outer collars 164', 166' is a gap 180' that differs significantly from those previously described. Instead of having an rectangular profile, the gap 180' has a irregular profile that increases the interfacial surface area between the flexible wall 152' and the cap 110'. In this embodiment, the profile corresponds to a sawtooth pattern, as viewed in cross-sectional reference plane extending radially through the sub-assembly 193. The sawtooth pattern includes a series of triangular grooves 181', each extending longitudinally along the perimeter of the cap 110'. When dispensing the component 150', the flexible wall 152' conforms to the series of grooves 181', thereby enhancing the seal between the flexible wall 152' and the cap 110' and preventing leakage.

Other aspects of the sub-assembly 193 are similar to those addressed in previous embodiments; thus, a description of such aspects will not be repeated here.

Figure 12:
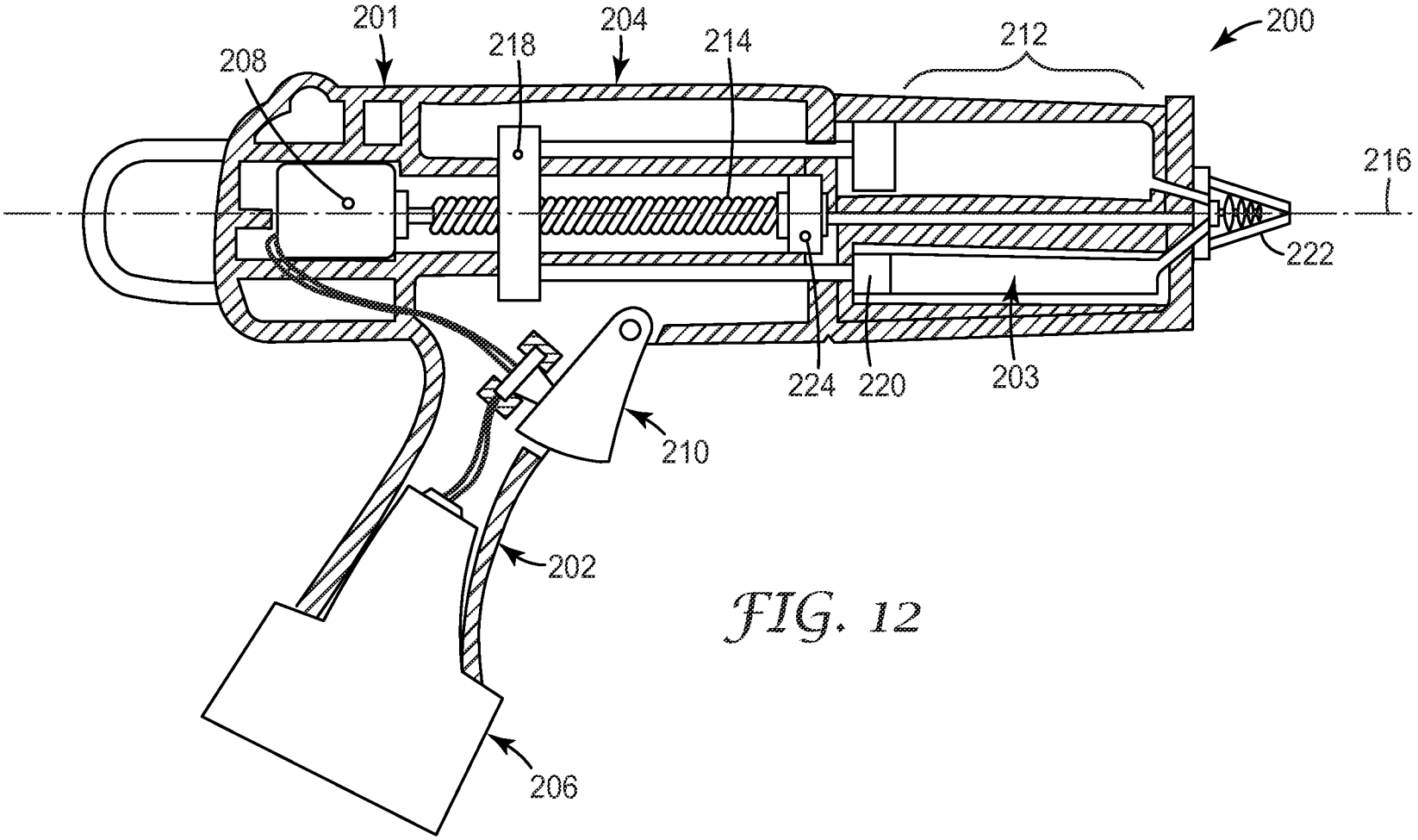
FIG. 12 is a side cross-sectional view of a mobile dispenser according to yet another exemplary embodiment.

FIG. 12 is a cross-sectional view of a mobile mixing dispenser 200 according to another embodiment. The dispenser 200 includes a frame 201, which further includes a barrel 204 and a pistol-grip type handle 202 extending from the barrel 204. The dispenser 200 also includes a power source 206 connected to a motor 208 though a trigger switch 210. The dispenser 200 also includes a chamber 212 in which a cartridge assembly 203 can be easily installed and removed. Aspects of the cartridge assembly 203 are analogous to those of cartridge assembly 100 and will not be repeated here. In an exemplary embodiment, the cartridge assembly 203 contains fixed volumes of two or more discrete components where, for example, the volume of the components is 5000 cubic centimeters or less, or in some instances 2000 cubic centimeters or less.

The motor 208 is operably connected to a ball screw 214 such that the motor 208 rotates the screw 214 about axis 216. As the screw 214 rotates, it drives a follower 218 along the axis 216, with directional control over movement of the follower 218 along the axis 216 being obtained by, e.g., selecting the direction of rotation of the screw 214. The dispenser 200 also includes plungers 220 operably connected to the follower 218 such that as the follower 218 moves towards the chamber 212, plungers 220 advance into the chamber 212 to force the components 150*a*, 150*b* from the cartridge assembly 203 into a mixing nozzle 222, which may be attached to the cartridge assembly 203, barrel 204, or both. As demonstrated by this configuration, the offset placement of the outlets 132*a*, 132*b*, as previously shown in FIG. 3*a*, can enable the contents of two relatively large containers to be dispensed into a small mixing nozzle 222. This feature, difficult to achieve in conventional self-sealing containers, saves space and reduces waste.

If the mixing nozzle 222 is a dynamic mixing nozzle including one or more movable elements within a mixing chamber (as is the nozzle 222 depicted in FIG. 10), then the dispenser 200 also preferably includes components to operate the dynamic mixer. In the embodiment depicted in FIG. 1, the dispenser 200 actuates the built-in drive shaft 138 of the cartridge assembly 203 that extends through the chamber 212 to reach the nozzle 222. The drive shaft 138 preferably couples with the nozzle 222 to rotate the moving elements of the nozzle 222.

In addition to the drive shaft 138, the dispenser 200 also includes an optional gearbox 224 operably coupled to both the lead screw 214 and drive shaft 138. The gearbox 224 is preferably capable of adjusting the rotational speed of the drive shaft 138 such that it differs from the rotational speed of the lead screw 214. In many instances, it may be preferred that the drive shaft 138 rotates faster than the screw 214 (although in some instances the opposite arrangement may be preferred). The gearbox 224 may provide a fixed increase in rotational speed or the gearbox 224 may be capable of selectively adjusting the relative rotational speeds of the screw 214 and drive shaft 138. While the depicted embodiment shows an electric power source, the dispenser 200 could also have a configuration allowing the pistons in the cartridge assembly 203 and the drive shaft 138 could be pneumatically driven.

Numerous advantages derive from the dispensing devices and methods described above. For example, these devices and methods obviate a sealing glue or other hardenable component to form a seal between the collapsible container and its housing structure. This provides for a cleaner and more reliable fluid connection that is leak-free and less vulnerable to potential adverse chemical reactions induced by the contents of the container. The conformal collapse of the flexible wall of the container against the outward-facing surfaces of the inner collar during a dispensing operation provides for efficient removal of the container contents, with minimal waste and less mess. The absence of a complex engagement mechanism between the collapsible container and its housing structure also allows for simpler and faster assembly by an untrained user. With less complexity in the assembly process, user error can be reduced and reliability improved in the seal formed between the container and the housing. Finally, these devices can facilitate manufacturing and hence reduce costs compared with alternative configurations, again because of their reduced complexity.

All of the patents and patent applications mentioned above are hereby expressly incorporated by reference. The embodiments described above are illustrative of the present invention and other constructions are also possible. Accordingly, the present invention should not be deemed limited to the embodiments described in detail above and shown in the accompanying drawings, but instead only by a fair scope of the claims that follow along with their equivalents.

What is claimed is:

1. A cartridge for a dispenser, the cartridge comprising:
- a collapsible container having a flexible wall and enclosing material to be dispensed;
- a cap secured to one end of the container, the cap comprising:
  - an outlet,
  - an inner collar at least partially surrounding the end of the container, and
  - an outer collar at least partially surrounding the inner collar;
- a shell releasably coupled to the cap, wherein the shell at least partially surrounds the inner collar; and
- a gap provided between the inner collar and the shell, the gap having a size sufficient to receive a folded section of the flexible wall as the container collapses and the material is dispensed through the outlet.

2. The cartridge of claim 1, wherein the flexible wall has a thickness ranging from 0.025 to 0.50 millimeters.

3. The cartridge of claim 2, wherein the flexible wall has a thickness ranging from 0.05 to 0.10 millimeters.

4. The cartridge of claim 1, wherein the gap has a transverse dimension ranging from 1 to 20 times the thickness of the flexible wall.

5. The cartridge of claim 4, wherein the gap has a transverse dimension ranging from 2.4 to 5 times the thickness of the flexible wall.

6. The cartridge of claim 1, wherein the collapsible container is adhesively joined to the cap.

7. The cartridge of claim 1, further comprising a guide member coupled to at least a portion of the flexible wall, the collar having a first terminal edge and the guide member having a second terminal edge opposing the first terminal edge, the first and second terminal edges being spaced apart from each other.

8. The cartridge of claim 1, wherein the collar has a terminal edge and at least a portion of the flexible wall extending beyond the terminal edge is stiffer than at least a portion of the flexible wall adjacent the collar.

9. The cartridge of claim 1, further comprising a piston slidably received in the shell for dispensing the materials from the container.

10. The cartridge of claim 1, wherein the container has an elongated configuration that is substantially symmetrical about a reference axis.

11. The cartridge of claim 10, wherein the outlet is offset from a geometric center of the cap as viewed along the reference axis.

12. The cartridge of claim 10, wherein the collar has an axial dimension of at least 5 percent of the overall length of the container as measured along a direction parallel to the reference axis.

13. The cartridge of claim 12, wherein the collar has an axial dimension of at least 40 percent of the overall length of the container as measured along a direction parallel to the reference axis.

14. The cartridge of claim 1, wherein the gap is annular and has a transverse dimension that is generally uniform along its circumference.

15. A cartridge for a dispenser, the cartridge comprising:

a collapsible container having a flexible wall and enclosing material to be dispensed; and a housing at least partially surrounding the container, the housing further comprising:

a cap having an outlet and a collar contacting the flexible wall of the container along an engagement surface; and a shell at least partially surrounding the cap, wherein the cap and shell collectively provide a gap extending along the perimeter of the collar adjacent the engagement surface, the gap having a transverse dimension sufficient to receive a folded section of the flexible wall as the container collapses and the material is dispensed through the outlet.

16. The cartridge of claim 15, wherein the engagement surface is an annular engagement surface and the gap is an annular gap.

17. The cartridge of claim 15, wherein the collar is an inner collar and further comprising an outer collar at least partially surrounding the inner collar, the shell being received in an annular recess between the inner and outer collars.

18. The cartridge of claim 15, wherein the container is a first container, the housing is a first housing, and further comprising a second housing and a second container, wherein the second housing is coupled to the first housing and at least partially surrounds the second container.

19. The cartridge of claim 18, wherein the first and second containers enclose respective first and second materials that are hardenable upon mixing with each other.

20. A method of sealing a collapsible container comprising:

providing a housing comprising a cap and a shell, the cap having an outlet and an inner collar and the shell at least partially received in the inner collar and radially displaced from the cap, whereby an outward-facing surface of the inner collar and an inward-facing surface of the shell are separated by a gap;

placing the collapsible container in the housing to provide a seal between an inward-facing surface of the inner collar and a flexible wall of the collapsible container; and collapsing at least a portion of the container whereby the flexible wall folds upon itself and progressively extends into the gap while conforming to the outward-facing surface of the collar to improve the seal as the materials are dispensed.

* * * * *